US012458132B2

(12) United States Patent
Liu

(10) Patent No.: US 12,458,132 B2
(45) Date of Patent: Nov. 4, 2025

(54) HAMMOCK STAND CAPABLE OF BEING QUICKLY COLLAPSED AND EXPANDED

(71) Applicant: XIAMEN XIRUI IMP & EXP CO., LTD., Xiamen (CN)

(72) Inventor: Ruiqian Liu, Xiamen (CN)

(73) Assignee: XIAMEN XIRUI IMP&EXP CO., LTD., Xiamen (CN)

( * ) Notice: Subject to any disclaimer, the term of this patent is extended or adjusted under 35 U.S.C. 154(b) by 0 days.

(21) Appl. No.: 18/289,892

(22) PCT Filed: Nov. 7, 2022

(86) PCT No.: PCT/CN2022/130228
§ 371 (c)(1),
(2) Date: May 28, 2024

(87) PCT Pub. No.: WO2024/082351
PCT Pub. Date: Apr. 25, 2024

(65) Prior Publication Data

US 2025/0089880 A1 Mar. 20, 2025

(30) Foreign Application Priority Data

Oct. 18, 2022 (CN) ..... 202211274645.5
Oct. 18, 2022 (CN) ..... 202222741060.1

(51) Int. Cl.
*A45F 3/22* (2006.01)
*A45F 3/24* (2006.01)
(Continued)

(52) U.S. Cl.
CPC ..... *A45F 3/24* (2013.01); *A47C 1/027* (2013.01); *A47C 3/0255* (2013.01); *A47C 4/286* (2013.01)

(58) Field of Classification Search
CPC ... A45F 3/24; A45F 3/22; A47C 4/286; A47C 17/84; A47D 13/06
See application file for complete search history.

(56) References Cited

U.S. PATENT DOCUMENTS

D295,242 S * 4/1988 Frick ..... D6/387
5,003,652 A * 4/1991 Bayless ..... A45F 3/24 5/127

(Continued)

FOREIGN PATENT DOCUMENTS

CH 690745 A5 1/2001
CN 2704249 6/2005

(Continued)

*Primary Examiner* — Justin C Mikowski
*Assistant Examiner* — Ifeolu A Adeboyejo
(74) *Attorney, Agent, or Firm* — Bayramoglu Law Offices LLC

(57) ABSTRACT

A hammock stand capable of being quickly collapsed and expanded includes a coupling frame assembly, a plurality of support legs, and a plurality of linkage assemblies, wherein the coupling frame assembly includes a base, two coupling rods, and two coupling pipes; lower ends of the coupling rods are respectively rotatably provided at two sides of the base; lower ends of the coupling pipes are respectively slidably sleeved on the coupling rods; the support legs are respectively provided at two sides of a lower portion of each of the coupling rods; the support legs each include an upper end hinged with the base, and a lower end extending to the ground; the linkage assemblies each include a plurality of inclined struts; an upper end and a lower end of each of the inclined struts are respectively rotatably connected to the coupling rod and the support leg through a connecting member.

8 Claims, 8 Drawing Sheets

(51) Int. Cl.

| | |
|---|---|
| ***A47C 1/027*** | (2006.01) |
| ***A47C 3/025*** | (2006.01) |
| ***A47C 4/28*** | (2006.01) |

(56) References Cited

U.S. PATENT DOCUMENTS

| | | | | |
|---|---|---|---|---|
| 5,392,476 | A * | 2/1995 | Williams | A45F 3/24 5/127 |
| 5,983,422 | A * | 11/1999 | Bayless | A45F 3/24 5/120 |
| 6,665,896 | B1 | 12/2003 | Tseng | |
| 6,931,679 | B1 * | 8/2005 | Tseng | A61K 31/513 5/127 |
| 6,973,687 | B1 * | 12/2005 | Tseng | A45F 3/24 5/127 |
| 12,127,687 | B1 * | 10/2024 | Zhang | A47C 4/30 |
| 2016/0058197 | A1 * | 3/2016 | Jungling | A45F 3/24 5/119 |
| 2019/0075915 | A1 * | 3/2019 | Wilke | A45F 3/24 |
| 2019/0365085 | A1 * | 12/2019 | Goodwin | A45F 3/24 |

FOREIGN PATENT DOCUMENTS

| | | | | |
|---|---|---|---|---|
| CN | 201431185 | | 3/2010 | |
| CN | 201767513 | | 3/2011 | |
| CN | 204908399 | U | 12/2015 | |
| CN | 109171319 | | 1/2019 | |
| CN | 216453856 | U | 5/2022 | |
| CN | 218246163 | U | 1/2023 | |
| DE | 2853993 | A1 | 7/1980 | |
| DE | 19753112 | A1 * | 6/1999 | A45F 3/24 |
| WO | 0174194 | A1 | 10/2001 | |

* cited by examiner

HAMMOCK STAND CAPABLE OF BEING QUICKLY COLLAPSED AND EXPANDED

CROSS REFERENCE TO THE RELATED APPLICATIONS

This application is the national phase entry of International Application No. PCT/CN2022/130228, filed on Nov. 7, 2022, which is based upon and claims priority to Chinese Patent Application No. 202211274645.5, filed on Oct. 18, 2022 and Chinese Patent Application No. 202222741060.1, filed on Oct. 18, 2022, the entire contents of which are incorporated herein by reference.

TECHNICAL FIELD

The present disclosure relates to the technical field of hammock devices, and in particular to a hammock stand capable of being quickly collapsed and expanded.

BACKGROUND

Hammocks are light and easy-to-carry bedding for outdoor activities. According to manufacturing materials, there are fabric hammocks and rope hammocks. The former is usually sewn with thin canvas or nylon cloth, while the latter is usually woven with a cotton rope or a nylon rope. A hammock is often tied to a tree trunk or other support in use. However, for places without an effective support, such as lawns and sand beaches, a hammock is inconvenient.

SUMMARY

An objective of the present disclosure is to provide a hammock stand capable of being quickly collapsed and expanded. When the coupling pipe and the coupling rod are locked together through the locking member, the hammock stand can be expanded, and two ends of a hammock are respectively provided on the two coupling pipes for resting. When the coupling pipe and the coupling rod are unlocked through the locking member, the coupling pipe can slide along the coupling rod. In this case, by pressing the coupling pipe, the coupling rod and the support leg, the hammock stand can be collapsed quickly. Therefore, the hammock stand capable of being quickly collapsed and expanded is stored or carried conveniently, and operated simply.

To achieve the above objective, the present disclosure adopts following technical solutions:

A hammock stand capable of being quickly collapsed and expanded includes a coupling frame assembly, a plurality of support legs, and a plurality of linkage assemblies, where the coupling frame assembly includes a base, two coupling rods, and two coupling pipes; lower ends of the coupling rods are respectively rotatably provided at two sides of the base; lower ends of the coupling pipes are respectively slidably sleeved on the coupling rods; the support legs are respectively provided at two sides of a lower portion of each of the coupling rods; the support legs each include an upper end hinged with the base, and a lower end extending to the ground; the linkage assemblies each include a plurality of inclined struts; an upper end and a lower end of each of the inclined struts are respectively rotatably connected to the coupling rod and the support leg through a connecting member; each of the coupling pipes is locked with the coupling rod through a locking member; and through locking or unlocking of the locking member, the hammock stand is expanded or collapsed.

Further, a plurality of locking holes are alternately formed along a length direction of the coupling rod; the locking member passes through the coupling pipe, with a lower end threadedly connected to each of the locking holes, thereby locking the coupling pipe to the coupling rod; and by adjusting mounting angles of the two coupling rods, a lying posture or a sitting posture of a hammock is switched.

Further, a mounting sleeve is sleeved on the coupling pipe; a plurality of adjusting holes are alternately formed in the coupling pipe from top to bottom; a mounting bolt passes through the mounting sleeve, with an inner end threadedly connected to each of the adjusting holes, thereby locking the mounting sleeve to the coupling pipe; and a hanging hole for hanging a hammock is formed in the mounting sleeve.

Further, the connecting member is a U-shaped buckle; the end of the inclined strut is rotatably connected to two winged edges of the U-shaped buckle; a bottom of the U-shaped buckle at the upper end of the inclined strut is rotatably connected to a sidewall of the coupling pipe; and a bottom of the U-shaped buckle at the lower end of the inclined strut is rotatably connected to a sidewall of the support leg.

Further, an upper end of the coupling pipe is provided with a connecting head; the connecting head includes a sleeve and two stabilizing members provided oppositely at two sides of the sleeve; the sleeve is fixed at an upper end of the coupling pipe in a sleeving manner; a lower end of each of the stabilizing members is fixedly connected to the sleeve; and a limiting groove is formed between the two stabilizing members.

Further, a mounting hole intersecting and communicating with the limiting groove is formed in the stabilizing member.

Further, a clamping groove is formed outside the stabilizing member; and a plurality of lockup holes communicating with the clamping groove are alternately formed in the stabilizing member from top to bottom.

Further, a hand hole is formed in an upper end of the base.

Further, there are four support legs and four inclined struts; and the coupling pipe is supported by two of the support legs and two of the inclined struts.

With the above technical solutions, the present disclosure has the following beneficial effects:

1. According to the hammock stand capable of being quickly collapsed and expanded provided by the present disclosure, when the coupling pipe and the coupling rod are locked together through the locking member, the hammock stand can be expanded, and two ends of a hammock are respectively provided on the two coupling pipes for resting. When the coupling pipe and the coupling rod are unlocked through the locking member, the coupling pipe can slide along the coupling rod. In this case, by pressing the coupling pipe, the coupling rod and the support leg, the hammock stand can be collapsed quickly. Therefore, the hammock stand capable of being quickly collapsed and expanded is stored or carried conveniently, and operated simply.

2. The hammock stand capable of being quickly collapsed and expanded provided by the present disclosure has good flexibility. A position of the coupling pipe on the coupling rod can be adjusted through the locking member. According to a mounting height required by the hammock, an opening angle between the two coupling rods can be adjusted to change a height of a top end of the coupling pipe, thereby switching a lying posture or a sitting posture of the hammock.

3. According to the hammock stand capable of being quickly collapsed and expanded provided by the present disclosure, the mounting bolt passes through the mounting sleeve, with the inner end threadedly connected to the adjusting hole, thereby adjusting a position of the mounting sleeve on the coupling pipe. Therefore, an end of the hammock is hung on the hanging hole conveniently.

4. According to the hammock stand capable of being quickly collapsed and expanded provided by the present disclosure, the hammock can be stably provided on the hammock stand through the connecting head, and thus the hammock is mounted or dismounted quickly. With the hand hole, the hammock stand can be carried conveniently. Therefore, the hammock stand has a good use effect.

IN THE FIGURES

Figure 1:
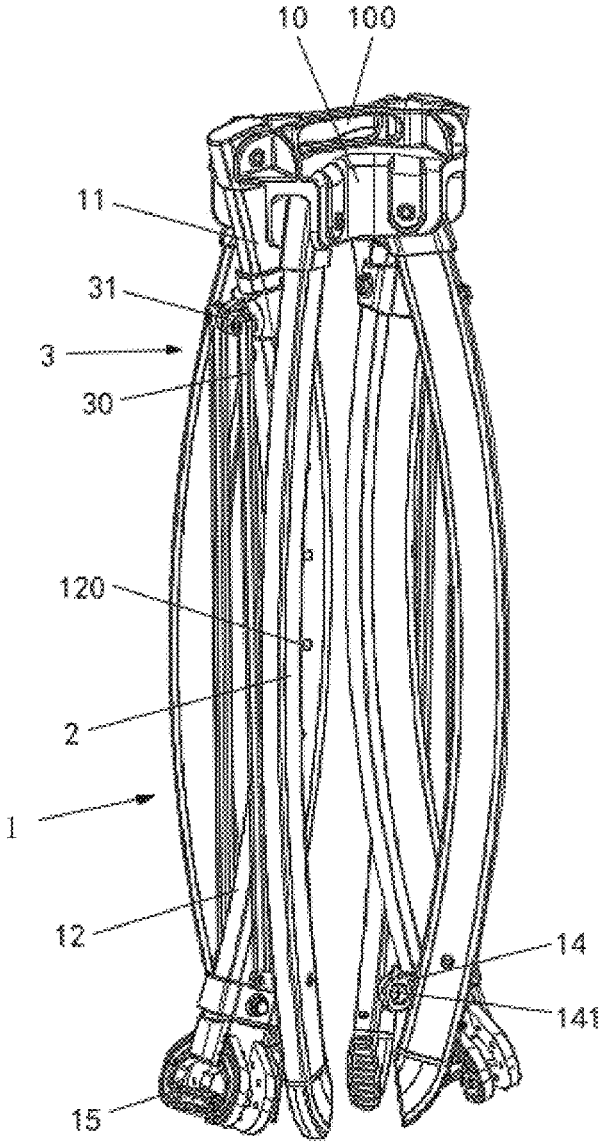
FIG. 1 is a schematic perspective view when the present disclosure is collapsed.

1. coupling frame assembly, 10: base, 100: hand hole, 11: coupling rod, 110: locking hole, 12: coupling pipe, 120: adjusting hole, 13: locking member, 14: mounting sleeve, 140: mounting bolt, 141: hanging hole, 15: connecting head, 150: sleeve, 151: stabilizing member, 1510: limiting groove, 1511: mounting hole, 1512: clamping groove, 1513: lockup hole, 2: support leg, 3: linkage assembly, 30: inclined strut, 31: connecting member, 32: first rotation shaft, and 33: second rotation shaft.

DETAILED DESCRIPTION OF THE EMBODIMENTS

In order to make the objectives, technical solutions, and advantages of the present disclosure clearer, the present disclosure is further described in detail below with reference to the accompanying drawings and embodiments. Understandably, the specific embodiments described herein are merely intended to explain the present disclosure but not to limit the present disclosure.

Referring to FIG. 1 to FIG. 9, a hammock stand capable of being quickly collapsed and expanded includes coupling frame assembly 1, a plurality of support legs 2, and a plurality of linkage assemblies 3. The coupling frame assembly 1 includes base 10, two coupling rods 11, and two coupling pipes 12. Lower ends of the coupling rods 11 are respectively rotatably provided at two sides of the base 10. Lower ends of the coupling pipes 12 are respectively slidably sleeved on the coupling rods 11. The support legs 2 are respectively provided at two sides of a lower portion of each of the coupling rods 11. The support legs 2 each include an upper end hinged with the base 10, and a lower end extending to the ground. The linkage assemblies 3 each include a plurality of inclined struts 30. An upper end and a lower end of each of the inclined struts 30 are respectively rotatably connected to the coupling rod 11 and the support leg 2 through connecting member 31. Each of the coupling pipe 12 is locked with the coupling rod 11 through locking member 13. Through locking or unlocking of the locking member 13, the hammock stand is expanded or collapsed.

Figure 2:
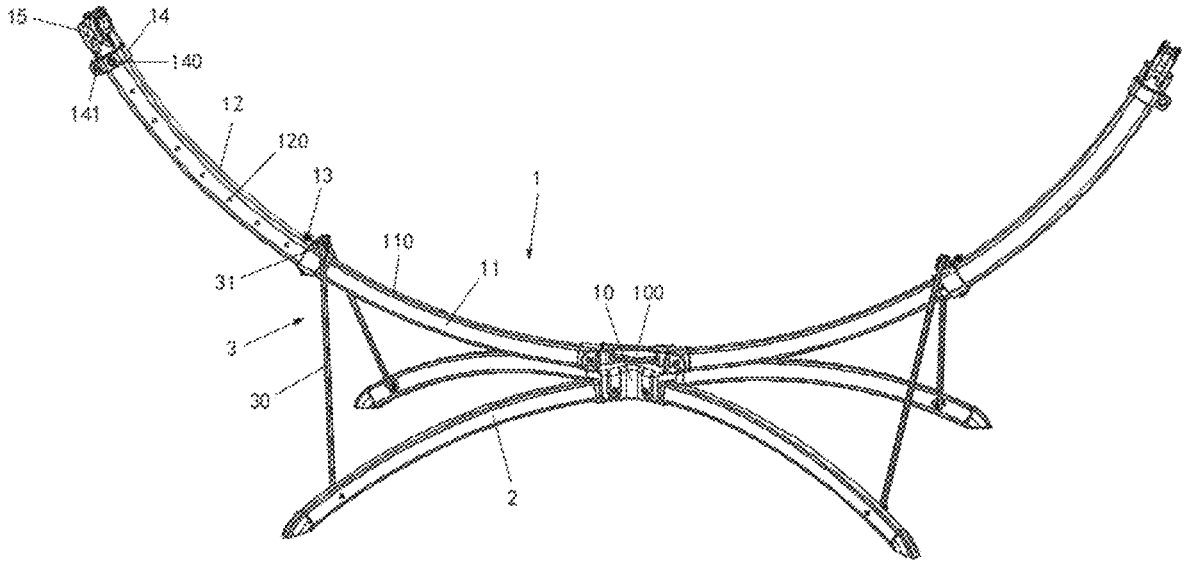
FIG. 2 is a schematic perspective view when the present disclosure is expanded for a lying posture.
Figure 3:
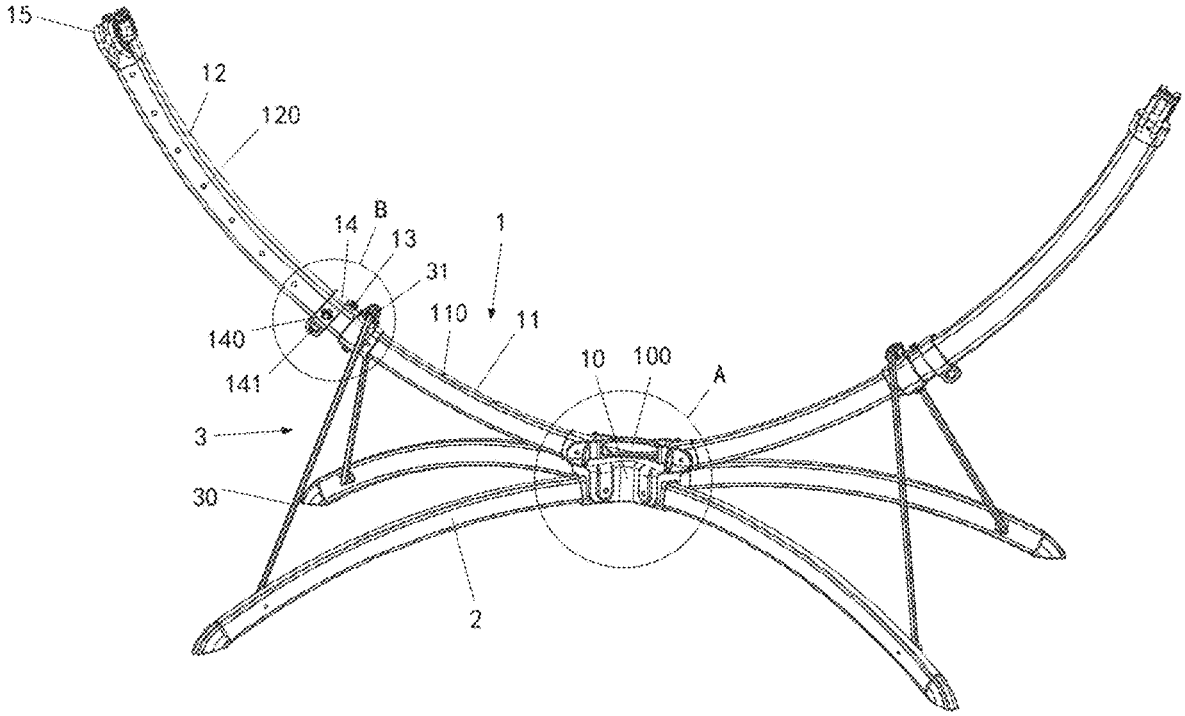
FIG. 3 is a schematic perspective view when the present disclosure is expanded for a sitting posture.
Figure 4:
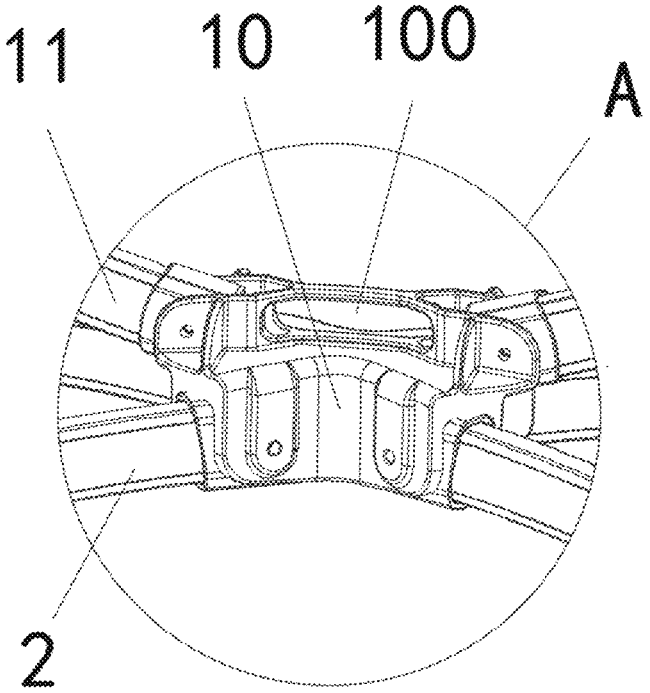
FIG. 4 is a partially enlarged view of A in FIG. 3.
Figure 5:
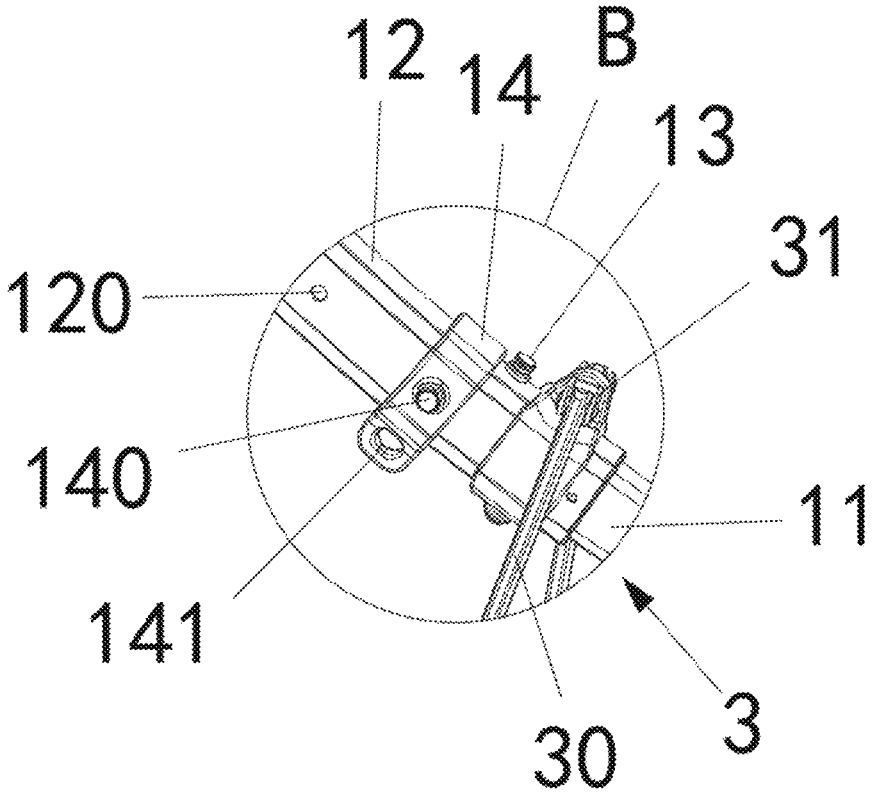
FIG. 5 is a partially enlarged view of B in FIG. 3.

As shown in FIG. 2 and FIG. 3, a plurality of locking holes 110 are alternately formed along a length direction of the coupling rod 11. The locking member 13 passes through the coupling pipe 12, with a lower end threadedly connected to each of the locking holes 110, thereby locking the coupling pipe 12 to the coupling rod 11. By adjusting mounting angles of the two coupling rods 11, a lying posture or a sitting posture of a hammock is switched.

As shown in FIG. 1, FIG. 2, FIG. 3, FIG. 5, FIG. 6 and FIG. 7, mounting sleeve 14 is sleeved on the coupling pipe 12. A plurality of adjusting holes 120 are alternately formed in the coupling pipe 12 from top to bottom. Mounting bolt 140 passes through the mounting sleeve 14, with an inner end threadedly connected to each of the adjusting holes 120, thereby locking the mounting sleeve 14 to the coupling pipe 12. Hanging hole 141 for hanging a hammock is formed in the mounting sleeve 14.

As shown in FIG. 1, FIG. 2, FIG. 3, FIG. 5, FIG. 8 and FIG. 9, the connecting member 31 is a U-shaped buckle. The end of the inclined strut 30 is rotatably connected to two winged edges of the U-shaped buckle through a first rotation shaft 32. A bottom of the U-shaped buckle at the upper end of the inclined strut is rotatably connected to a sidewall of the coupling pipe 12 through a second rotation shaft 33. A bottom of the U-shaped buckle at the lower end of the inclined strut is rotatably connected to a sidewall of the support leg 2.

Figure 6:
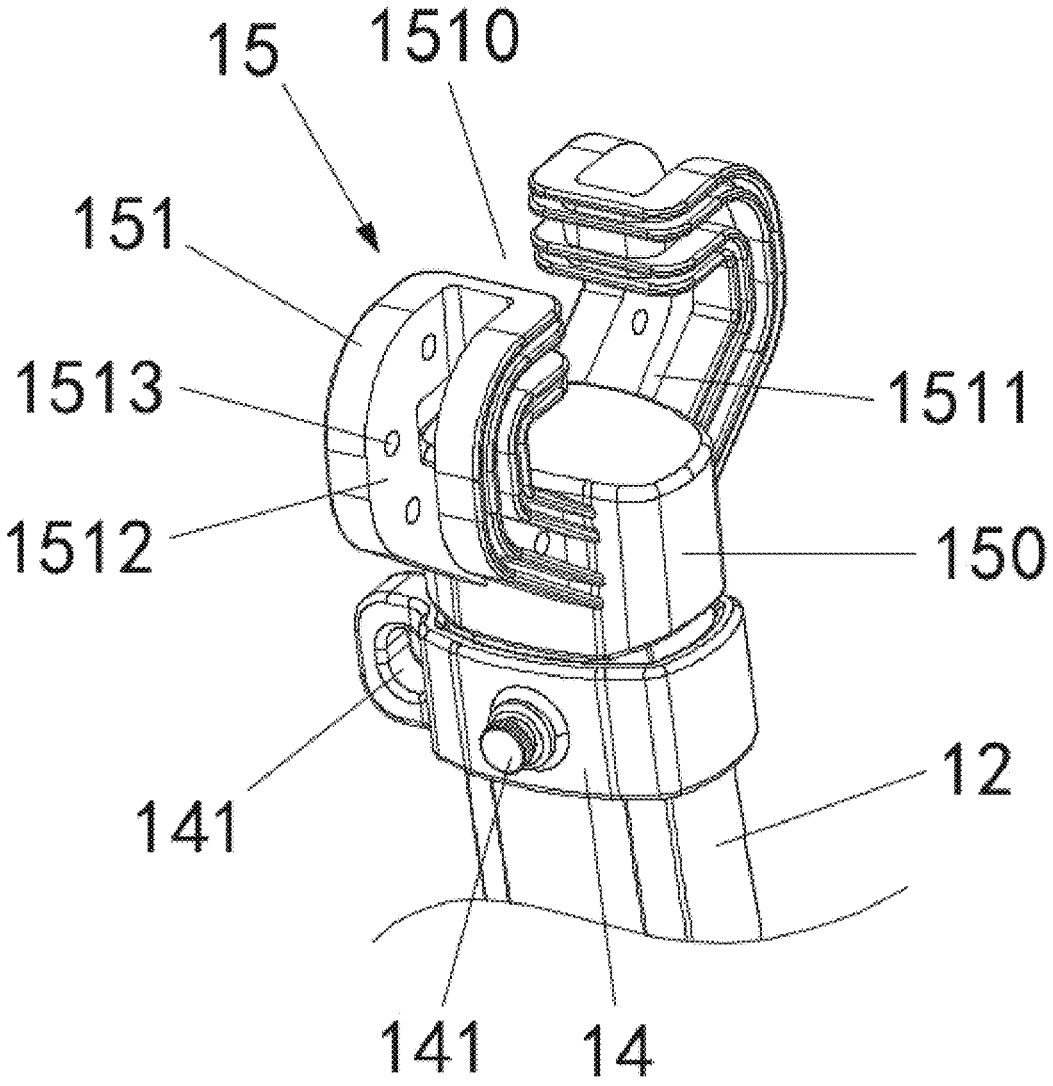
FIG. 6 is a schematic perspective view of a connecting head according to the present disclosure.
Figure 7:
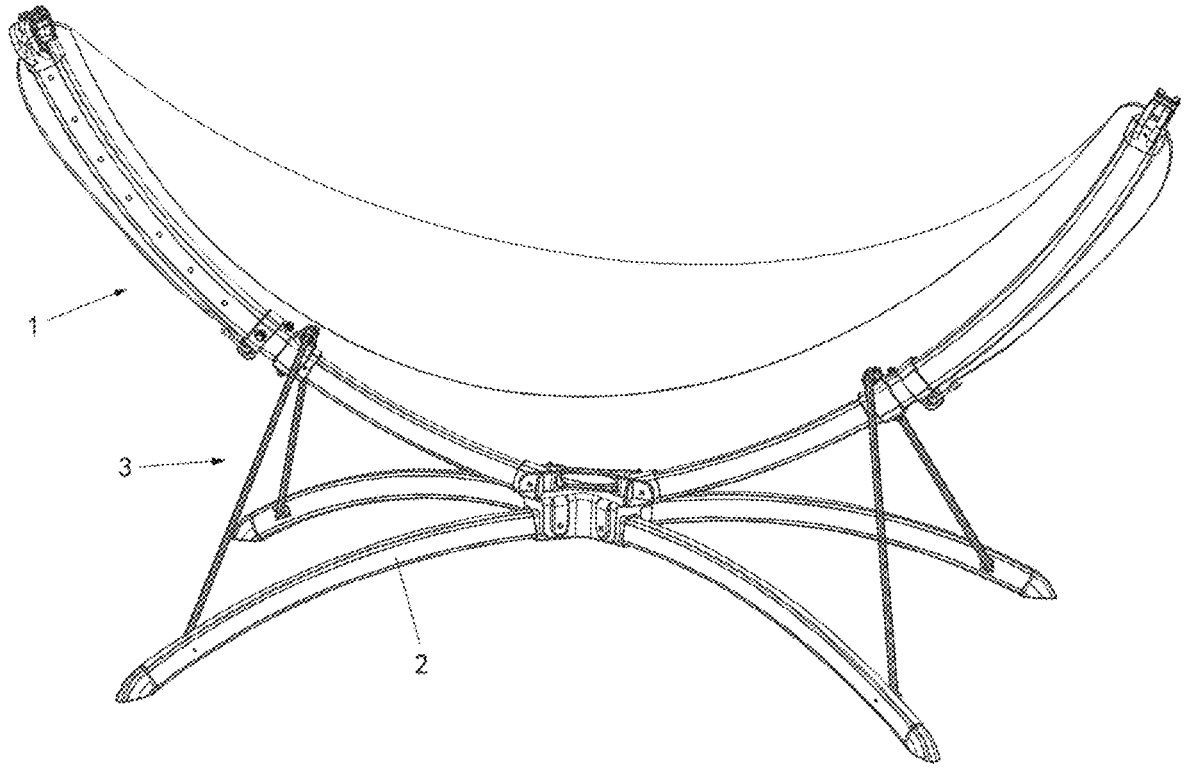
FIG. 7 is a schematic structural view after a hammock is provided according to the present disclosure.
Figure 8:
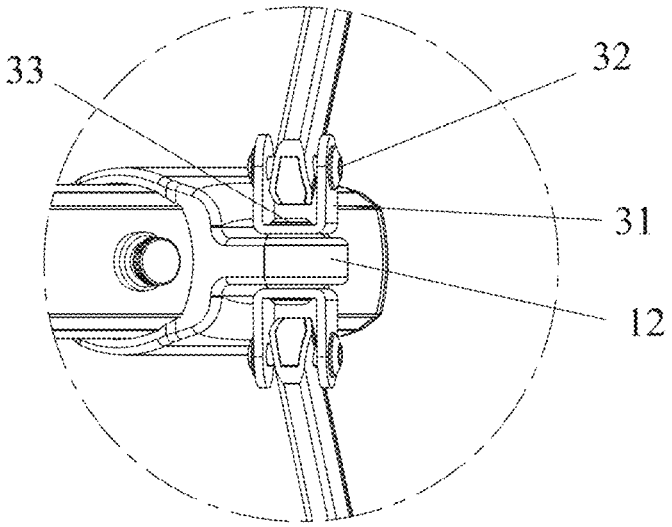
FIG. 8 is a first enlarged view of a connecting member.
Figure 9:
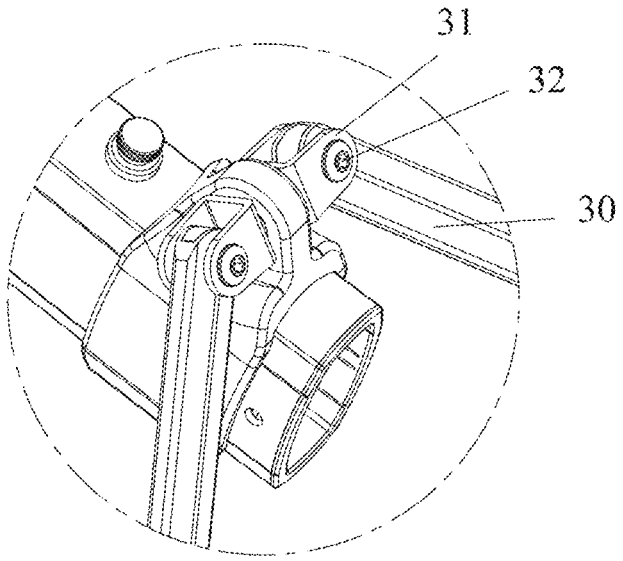
FIG. 9 is a second enlarged view of the connecting member.

As shown in FIG. 2, FIG. 3 and FIG. 6, an upper end of the coupling pipe 12 is provided with connecting head 15. The connecting head 15 includes sleeve 150 and two stabilizing members 151 provided oppositely at two sides of the sleeve 150. The sleeve 150 is fixed at an upper end of the coupling pipe 12 in a sleeving manner. A lower end of each of the stabilizing members 151 is fixedly connected to the sleeve 150. Limiting groove 1510 is formed between the two stabilizing members 151.

As shown in FIG. 2, FIG. 3 and FIG. 6, mounting hole 1511 intersecting and communicating with the limiting groove 1510 is formed in the stabilizing member 151.

As shown in FIG. 2, FIG. 3 and FIG. 6, clamping groove 1512 is formed outside the stabilizing member 151. A plurality of lockup holes 1513 communicating with the clamping groove 1512 are alternately formed in the stabilizing member 151 from top to bottom.

As shown in FIG. 1, FIG. 2, FIG. 3, FIG. 4 and FIG. 7, hand hole 100 is formed in an upper end of the base 10.

As shown in FIG. 1, FIG. 2, FIG. 3, FIG. 4 and FIG. 7, there are four support legs 2 and four inclined struts 30; and the coupling pipe 12 is supported by two of the support legs 2 and two of the inclined struts 30.

The above are merely preferred specific implementations of the present disclosure, but the protection scope of the present disclosure is not limited thereto. Any modification or replacement easily conceived by those skilled in the art within the technical scope of the present disclosure should fall within the protection scope of the present disclosure. Therefore, the protection scope of the present disclosure should be subject to the protection scope of the claims.

What is claimed is:

1. A hammock stand capable of being quickly collapsed and expanded, comprising a coupling frame assembly, a plurality of support legs, and a plurality of linkage assemblies, wherein the coupling frame assembly comprises a base, two coupling rods, and two coupling pipes;

lower ends of the two coupling rods are respectively rotatably provided at two sides of the base;

lower ends of the two coupling pipes are respectively slidably sleeved on the two coupling rods;

the plurality of support legs are respectively provided at two sides of a lower portion of each of the two coupling rods;

the plurality of support legs each comprise an upper end hinged with the base, and a lower end extending to the ground;

the plurality of linkage assemblies each comprise a plurality of inclined struts;

an upper end and a lower end of each of the plurality of inclined struts are respectively rotatably connected to the coupling rod and the support leg through a connecting member;

each of the two coupling pipes is locked with each of the two coupling rods through a locking member; and through locking or unlocking of the locking member, the hammock stand is expanded or collapsed, wherein the connecting member is a U-shaped buckle, the upper end of the inclined strut is rotatably connected to two winged edges of the U-shaped buckle and a bottom of the U-shaped buckle is rotatably connected to a sidewall of the coupling pipe.

2. The hammock stand according to claim 1, wherein a plurality of locking holes are alternately formed along a length direction of the coupling rod; the locking member passes through the coupling pipe, with a lower end threadedly connected to each of the plurality of locking holes, thereby locking the coupling pipe to the coupling rod; and by adjusting mounting angles of the two coupling rods, a lying posture or a sitting posture of a hammock is switched.

3. The hammock stand according to claim 1, wherein a mounting sleeve is sleeved on the coupling pipe; a plurality of adjusting holes are alternately formed in the coupling pipe from top to bottom; a mounting bolt passes through the mounting sleeve, with an inner end threadedly connected to each of the plurality of adjusting holes, thereby locking the mounting sleeve to the coupling pipe; and a hanging hole for hanging a hammock is formed in the mounting sleeve.

4. The hammock stand according to claim 1, wherein an upper end of the coupling pipe is provided with a connecting head; the connecting head comprises a sleeve and two stabilizing members provided oppositely at two sides of the sleeve; the sleeve is fixed at an upper end of the coupling pipe in a sleeving manner; a lower end of each of the two stabilizing members is fixedly connected to the sleeve; and a limiting groove is formed between the two stabilizing members.

5. A hammock stand capable of being quickly collapsed and expanded, comprising a coupling frame assembly, a plurality of support legs, and a plurality of linkage assemblies, wherein the coupling frame assembly comprises a base, two coupling rods, and two coupling pipes:

lower ends of the two coupling rods are respectively rotatably provided at two sides of the base;

lower ends of the two coupling pipes are respectively slidably sleeved on the two coupling rods;

the plurality of support legs are respectively provided at two sides of a lower portion of each of the two coupling rods;

the plurality of support legs each comprise an upper end hinged with the base, and a lower end extending to the ground;

the plurality of linkage assemblies each comprise a plurality of inclined struts;

an upper end and a lower end of each of the plurality of inclined struts are respectively rotatably connected to the coupling rod and the support leg through a connecting member;

each of the two coupling pipes is locked with each of the two coupling rods through a locking member; and through locking or unlocking of the locking member, the hammock stand is expanded or collapsed, wherein an upper end of the coupling pipe is provided with a connecting head; the connecting head comprises a sleeve and two stabilizing members provided oppositely at two sides of the sleeve: the sleeve is fixed at an upper end of the coupling pipe in a sleeving manner; a lower end of each of the two stabilizing members is fixedly connected to the sleeve; and a limiting groove is formed between the two stabilizing members, and wherein a mounting hole intersecting and communicating with the limiting groove is formed in the stabilizing member.

6. The hammock stand according to claim 5, wherein a clamping groove is formed outside the stabilizing member; and a plurality of lockup holes communicating with the clamping groove are alternately formed in the stabilizing member from top to bottom.

7. The hammock stand according to claim 1, wherein a hand hole is formed in an upper end of the base.

8. The hammock stand according to claim 1, wherein there are four support legs and four inclined struts; and each of the two coupling pipes is supported by two of the four support legs and two of the four inclined struts.

* * * * *